United States Patent [19]

Fletcher et al.

[11] 4,045,063

[45] Aug. 30, 1977

[54] LOAD REGULATING LATCH

[76] Inventors: James C. Fletcher, Administrator of the National Aeronautics and Space Administration, with respect to an invention of; Walter Thomas Appleberry, Long Beach, Calif.

[21] Appl. No.: 641,784

[22] Filed: Dec. 18, 1975

[51] Int. Cl.[2] ..... E05C 5/04

[52] U.S. Cl. ..... 292/110

[58] Field of Search ..... 292/242, 110, 109, 114, 292/DIG. 15

[56] References Cited

U.S. PATENT DOCUMENTS

| | | | |
|---|---|---|---|
| 809,209 | 1/1906 | O'Connor | 292/110 X |
| 1,483,953 | 2/1924 | Rainey | 292/114 |
| 2,988,392 | 6/1961 | Chi Sheng Kuo | 292/DIG. 15 |
| 3,797,882 | 3/1974 | Brimhall | 292/110 X |
| 3,825,295 | 7/1974 | Saunders et al. | 292/110 |

*Primary Examiner*—Richard E. Moore
*Attorney, Agent, or Firm*—Carl O. McClenny; John R. Manning; Marvin F. Matthews

[57] ABSTRACT

In one exemplary embodiment, a load regulating mechanical latch is provided that has a pivotally mounted latch element having a hook-shaped end with a strike roller-engaging laterally open hook for engaging a stationary strike roller. The latch element or hook is pivotally mounted in a clevis end of an elongated latch stem that is adapted for axial movement through an opening in a support plate or bracket mounted to a structural member. A coil spring is disposed over and around the extending latch stem and the lower end of the coil spring engages the support bracket. A thrust washer is removably attached to the other end of the latch stem and engages the other end of the coil spring and compresses the coil spring thereby preloading the spring and the latch element carried by the latch stem. The hook-shaped latch element has a limited degree of axial travel for loading caused by structural distortion which may change the relative positions of the latch element hook and the strike roller. Means are also provided to permit limited tilt of the latch element due to loading of the hook.

25 Claims, 9 Drawing Figures

FIG. 1
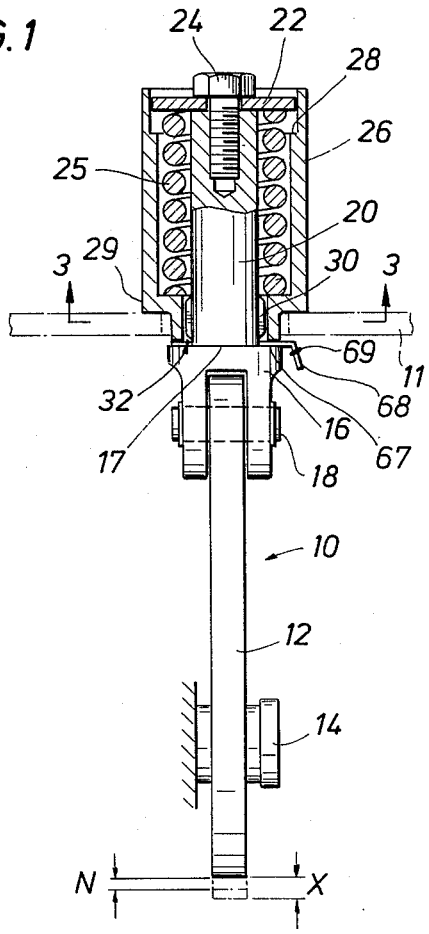
FIG. 2
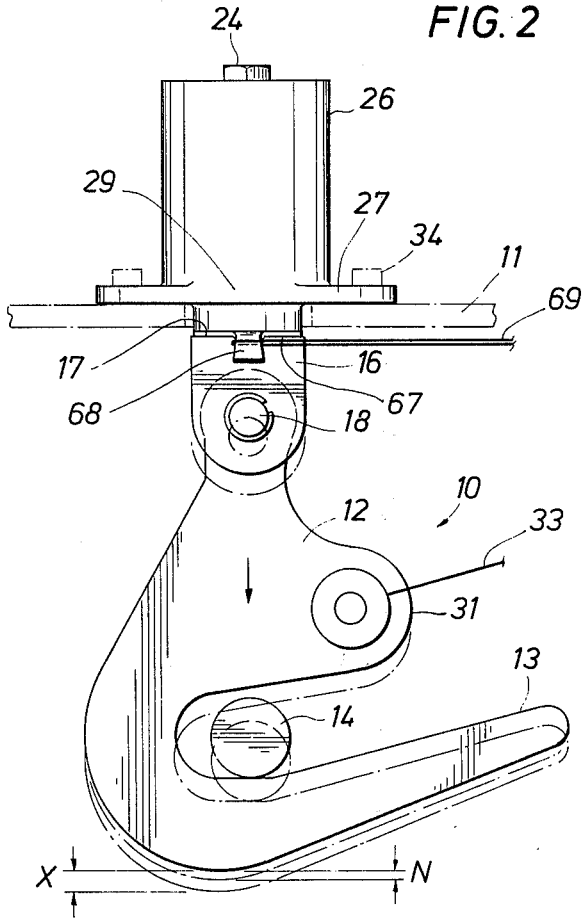
FIG. 3
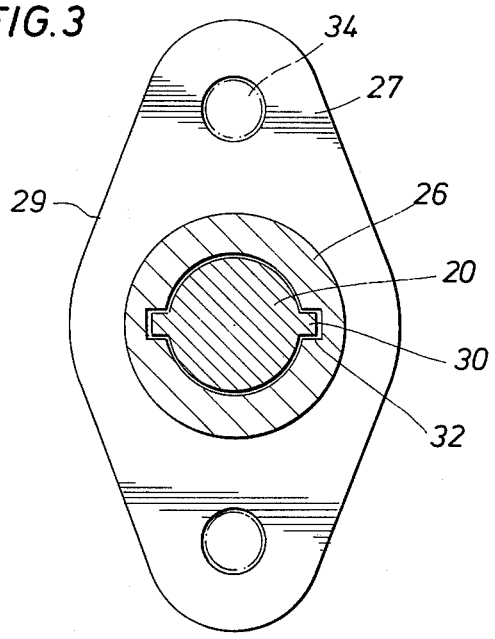
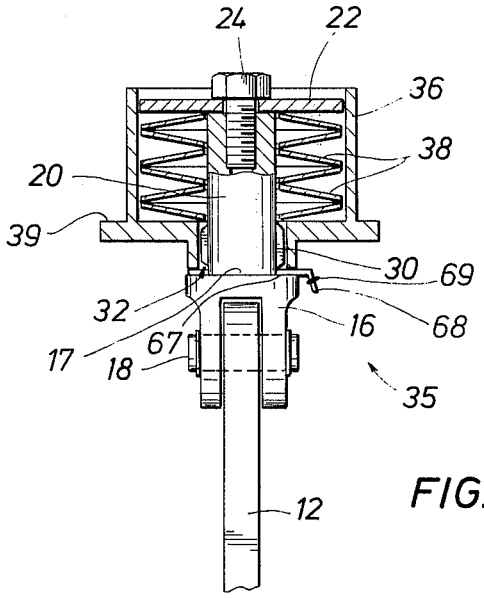
FIG. 4

FIG. 5
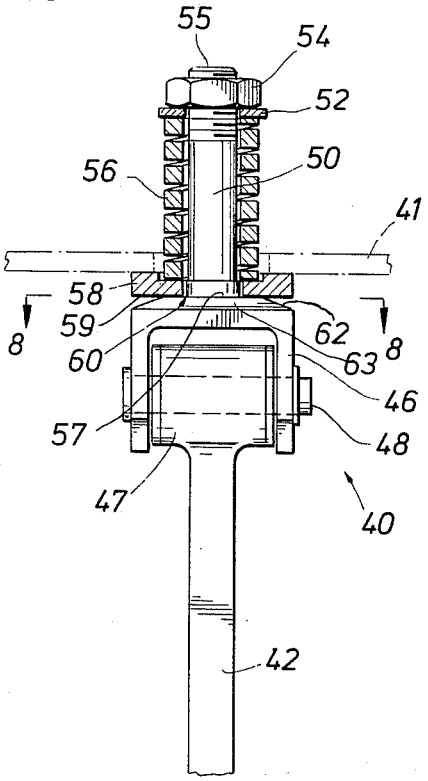
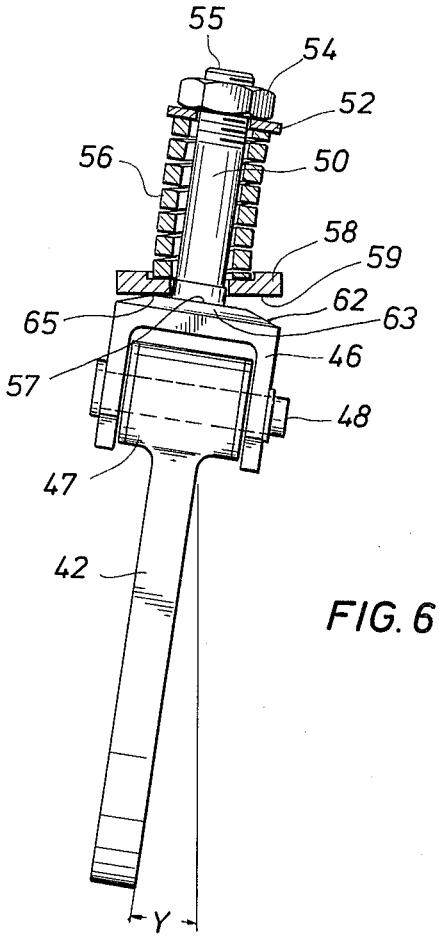
FIG. 6
FIG. 7
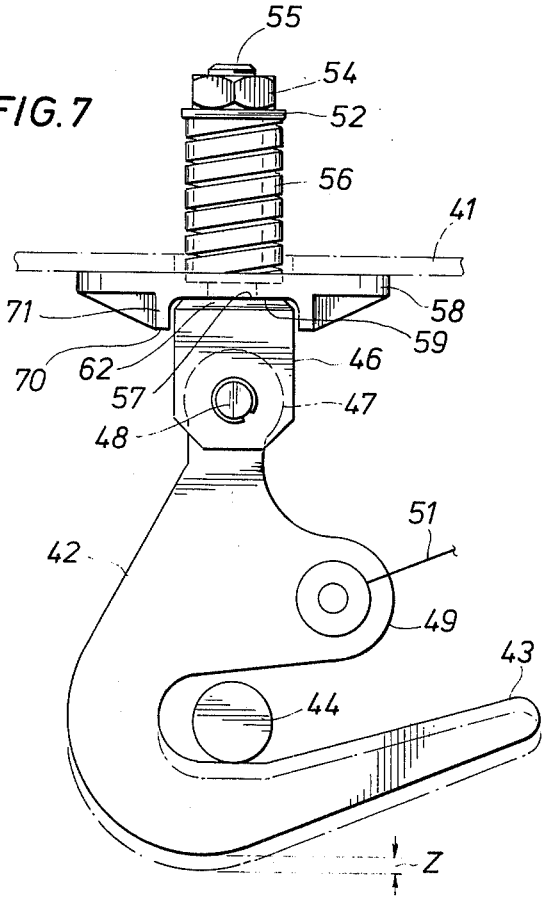
FIG. 8
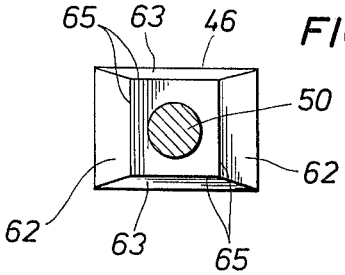
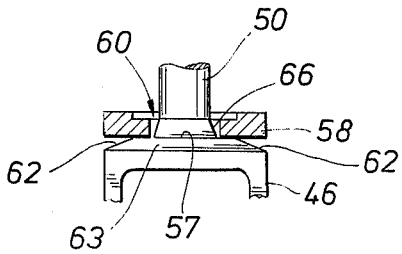
FIG. 9

LOAD REGULATING LATCH

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

This invention relates to the load regulating mechanical latches. More specifically, this invention relates to improved load regulating latches for utilization on remotely latched doors or because the latches are not accessible when a door is closed on space vehicles. Such load regulating latches compensate for structural deflections caused by launch thrust, flight loads or temperature changes in the structure of the vehicle.

Prior rigging methods of latches for doors, hatches and other covers utilized in space vehicles have utilized strain gauges to indicate loading, which requires wiring access, not always obtainable, expensive installation and skilled technicians to install. Other prior rigging methods for latch load adjustment on installation include plastic wire disposed at the latch-striker roller interface. The plastic deformation and load is then measured, the plastic removed, and a shim added or removed to compensate for the load. However, extremely skilled labor is required, and the results are uncertain. Hand rigging (latch adjustment) for some space vehicle doors requires an estimated 100 hours rigging time per door.

The prior art also includes mechanical latches having spring loading to urge the latch element into or out of keeper or strike engagement, and means for axially moving the latch element axially for limited distances. Such prior art is exemplified by the following U.S. Pat. Nos. 3,752,519; 3,612,591; 3,430,645; 2,939,663; 2,936,142; 2,593,502; 2,589,726; and 2,397,094.

Accordingly, one primary feature of the present invention is to provide a load regulating latch for permitting axial latch motion and elimination of time consuming rigging procedures.

Another feature of the present invention is to provide a load regulating latch that guarantees latch load regulation and service.

Yet another feature of the present invention is to provide a load regulating latch that protects against latch overloads, thus allowing weight reduction in latch design.

Still another feature of the present invention is to provide load sharing between identical mechanical latches that vary in distance from the hinge of a door or other pivotal cover.

Another feature of the present invention is to provide a load regulating latch that permits limited lateral latch motion due to structural deformations.

Yet another feature of the present invention is to provide a load regulating latch that permits limited load relief above a predetermined latch actuation force by limited tilting of the latch stem and clevis element in the swing plane of the latch.

Still another feature of the present invention is to provide a load regulating latch that permits visual verification of compression spring travel after the door has been closed and latched, then opened so that the latch can be visually inspected.

SUMMARY OF THE INVENTION

The present invention remedies the problems of the prior art by providing a self regulating and self rigging mechanical latch that comprises a prepositioned strike roller, a hook-shaped latch element having a strike roller-engaging, laterally open hook at one end with the other end adapted for pivotal mounting. The strike roller-engaging surface of the latch element acting to cam the striker roller into engagement with the latch element when a predetermined load is exerted between the latch element and the strike roller. In addition, the latch comprises means for pivotally moving the latch element, a latch stem having a clevis element at one end for pivotally mounting the latch element, a support bracket for supporting the latch stem and pivotally mounted latch element in strike roller-engaging position, and an adjustable loading means cooperating with the latch stem and support bracket for permitting limited axial movement of the latch stem and adjustable for exerting a predetermined load between the latch element and the strike roller.

In accordance with a further principle of this invention, the adjustable loading means comprises a compression spring means disposed around the latch stem, one end of the spring means engaging the support bracket, a thrust washer removably attached to the end of the latch stem and engaging the other end with a compression spring means for permitting limited axial movement of the latch stem, and a load adjusting bolt for attaching the thrust washer to the free end of the latch stem and utilized to preload the compression spring means. The compression spring means may either be a coil spring or a disc type (belleville) spring.

In addition, another embodiment of the load regulating latch permits limited tilt of the latch element in both the lateral and operating planes, in addition to axial movement of the latch.

In one embodiment, the opening in the support bracket through which the latch stem is inserted is made slightly oversize to allow for limited tilt of the latch stem in the opening, and tilt edges are provided on a shoulder carried by the latch stem and adjacent the clevis end of the stem that provide pivot points about which the shoulder allows pivotal movement of the latch stem and carried latch element to provide limited lateral movement due to lateral loading of the hook-shaped latch. In a second embodiment, the opening in the support bracket through which the latch stem is inserted is close fitting about the latch stem, the stem having a frusto-conical surface which permits tilting of said stem in the close fitting opening of the bracket.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope for the invention may admit to further equally effective embodiments.

In the Drawings

FIG. 1 is an end view, partly in cross section, of an embodiment of the load regulating mechanical latch according to the present invention.

FIG. 2 is a side elevational view of one embodiment of the load regulating mechanical latch according to the present invention.

FIG. 3 is a horizontal cross-sectional view of one embodiment of the load regulating mechanical latch as taken along lines 3—3 of FIG. 1.

FIG. 4 is an end view, partly in cross section, of a second embodiment of the load regulating mechanical latch according to the present invention.

FIG. 5 is an end view, partly in cross section, of a third embodiment of the load regulating mechanical latch according to the present invention.

FIG. 6 is an end view, partly in cross section, of the third embodiment of the load regulating mechanical latch shown in FIG. 5, illustrating the tilt capability of the third embodiment.

FIG. 7 is a side elevational view of the third embodiment of the load regulating mechanical latch according to the present invention.

FIG. 8 is a horizontal cross-sectional view of the latch stem showing a plan view of the shoulder disposed on the latch stem adjacent its clevis end, as taken along the lines 8—8 of FIG. 5.

FIG. 9 is a fragmentary cross section of the support bracket, latch stem and latch stem shoulder showing a variation in the fit of said latch stem through the opening of the support bracket for providing tilt capability.

DETAILED DESCRIPTION OF THE PREFERRED EMBODIMENTS

Referring now to FIGS. 1, 2 and 3, a first embodiment of the load regulating mechanical latch 10 will be described in detail. Latch element 12 is hook-shaped having a strike roller-engaging laterally open hook 13 at one end, while the other end is adapted for pivotal movement about pivot pin 18 disposed through latch element 12 and the clevis end or element 16 integrally attached to latch stem 20. The strike roller-engaging surface 13 of latch element 12 is designed to cam the prepositioned strike roller 14 into engagement with latch element 12 when a predetermined load is exerted between the latch element 12 and strike roller 14 as will hereinafter be further explained. An actuating line, wire or rod 33 is attached to actuating tab 31 of latch element 12 to provide means for pivotally moving the latch element 12.

A support bracket 29 has an opening for accommodating axial movement of latch stem 20 and is fastened to a structural member 11 by means of conventional fasteners such as bolts 34, cooperating with mounting flanges 27. A coil spring 25 is disposed about latch stem 20 and one end engages support bracket 29. A thrust washer 22 is removably attached to the upper end of latch stem 20 by means of a load adjusting bolt 24. The thrust washer 22 engages the other end of the coil spring 25 and permits limited axial movement of the latch stem 20 against the compression load of coil spring 25. The bolt 24 permits limited adjustment of the spacing between the end of latch stem 20 and thrust washer 22 for adjusting the load exerted by the coil spring 25 against the thrust washer 22 and latch stem 20.

A shoulder 17 disposed on the latch stem 20 adjacent the clevis end 16 engages the lower surface of support bracket 29 and limits upward axial movement of the latch stem 20 and the pivotally mounted latch element 12. Radially extending splines 30 are axially disposed over a portion of the length of latch stem 20 adjacent shoulder 17 and engage mating slots 32 in the support bracket to permit relative axial movement between the latch stem 20 and support bracket 29 but prohibits relative rotational movement between the latch stem 20 and support bracket 29.

If desired, overload protection can be provided by providing a housing 26 disposed around latch stem 20, coil spring 25 and thrust washer 22 that has a laterally disposed shoulder 28 about the inner periphery of housing 26 and located below thrust washer 22 for engaging the washer 22 after a predetermined amount of axial travel of latch stem 20. The predetermined axial travel of latch stem 20 relates to a predetermined compression load applied to coil spring 25, and the overload stop may be provided to limit axial travel of latch stem 20 and prevent damage to coil spring 29. Of course, if overload shoulder 28 is not provided, the overload will be limited by the solid stack height of the coil spring under maximum compression.

The compression spring means 25, thrust washer 22 and load adjusting bolt 24 combine to form an adjustable loading means cooperating with the latch stem 20 and the support bracket 29 for permitting limited axial movement of the latch stem 20 and adjustable for exerting a predetermined load between the latch element 12 and the strike roller 14.

The above load regulating mechanical latch is particularly useful in latching remote doors in aircraft/space vehicle applications where structural deformations due to launch thrust, flight loads or temperature could excessively load the latch. Use of the spring regulation of latch loads as herein described can eliminate long rigging time per latch and conventional latches, guarantee latch load regulation in service, protect against latch overloads, thus allowing a weight reduction in latch design, and permits load sharing between latches that vary in distance from the door hinge.

To adjust or predetermine the load of the latch, the initial predetermined load is set at the minimum desired load for the latched condition. The strike roller-engaging laterally open hook end 13 is designed, as hereinabove described, to pull the strike roller 14 towards engagement with the latch element 12 by camming action. The final position of the strike roller 14 is selected such that the minimum desired load is exceeded when engaged by latch element 12, causing the strike roller-engaging surface 13 to cam the latch element 12 into engagement with the strike roller by a load amount exceeding any manufacturing and assembly tolerances surrounding the nominal locations of the hook 13 and strike roller 14 interface. Beyond this point additional travel of latch stem 20 and loading by spring 25 is allowed for any anticipated structural deflections during the service life of the latch, protecting against overloads.

In practice, strike roller 14 would be prepositioned such that upon engagement with latch element 12, the latch element 12 would move toward the strike roller 14 by a nominal amount exceeding any manufacturing and assembly tolerances as above described, and shown in FIGS. 1 and 2 as N. Total latch element 12 travel permitted thus allowing maximum overload is shown by X in FIGS. 1 and 2. In practice, N is 0.063 inches and X is 0.125 inches. In practice the preloading on the spring has been set to 220 pounds and produces a miximum force of 280 pounds when compressed the full 0.125 inches by latch element 12. The nominal spring force is 250 pounds at a latch element 12 travel of 0.063 inches. The compression spring 25 utilized had a wire diameter of 0.148 inches, seven coils and had a free length of 1.67 inches. Preloading of spring 25 by adjustment of bolt 24 and thrust washer 22 compressed the spring 25 to 1.19 inches.

In addition to regulating the latch tension load and preventing overloads, the invention also produces load sharing among identical latches on a door. Rigidly mounted latches do not share closing loads that occur during the latching operation, loads such as door or jamb warpage, or as is more often the case, compression of the door seal. The latch farthest from the door hinge does all the work until the very last, when the strike rollers are fully seated. This means that the intermediate latches that are nearer the hinge do not touch the strike roller until just before latching is completed. In the present invention the latch element 12 is designed to move toward the strike roller 14 by a nominal amount of 0.063 inches during latching in order to reach its fully latched position. In a relative sense, the latch element 12 is initially 0.063 inches farther from the strike roller 14 than would be a rigidly mounted latch above described. The latch element 12 of the present invention will therefore contact the strike roller 14 earlier in its stroke. It will make contact in mid-stroke at the latest, picking up the load and relieving the load on other latches by such load sharing.

FIG. 4 shows a second embodiment 35 of the present invention. The latch element 12, latch stem 20, clevis end 16, pin 18, shoulder 17, splines 30, slots 32, thrust washer 22 and load adjusting bolt 24 are identical in construction to corresponding members shown in FIGS. 1, 2 and 3 and hereinabove described. However, the compression spring means compresses a disc type (belleville) springs 38. Coil springs 25 (FIG. 1) are cheaper, smaller in diameter and about the same weight as the disc type spring 38, but the disc type spring is shorter than an equivalent coil spring stock and thus may be employed where space requirements dictate a shorter spring length.

FIGS. 1, 2 and 4 show a verifying means comprising washer 67, a tab 68 integral to the washer 67, and an force exerting means 69 such as a rubber band or tension spring having one end attached to the tab 68 and the other end attached to any convenient point nearby (not shown) that results in the tension force in the force exerting means 69 being applied approximately tangential to the circumference of washer 67. The purpose of washer 67 is to provide visible indication that the spring 25 or 38 compresses when the latch 12 is closed and engaging the strike roller 14. Since this can only happen when the door is closed and the latch hidden from view, a verifying means is desirable in order to verify that the spring 25 or 38 has compressed during latch engagement as it should. Such inspection is normally required only during the initial door and latch installation, after which the elastic means 69 may be removed. Proper spring compression is verified by unlatching and opening the door and observing that the washer 67 has rotated approximately 90° about the axial centerline of the latch. Such rotation is verified by noting the angular displacement of the tab 68 from its initial position. Rotation of the washer 67 is permitted when the initial clamping force of the spring 25 or 38 is relieved by such compression of said spring as to produce axial motion of shoulder 17 relative to housing 26.

Referring now to FIGS. 5, 6 and 7, a third embodiment 40, capable of limited tilt of the load regulating latch in both the lateral and operating planes is shown. Latch element 42 is also hook-shaped having a strike roller engaging laterally open hook 43 at one end, the other end being adapted for pivotal movement about pivot pin 48 disposed through latch element 42 and the clevis end 46 integrally attached to latch stem 50. As hereinabove described, for previous embodiments, the strike roller-engaging surface 43 of latch element 42 is designed to cam the prepositioned strike roller 44 into engagement with latch element 42 when a predetermined load is exerted between the latch element 12 and the strike roller 44. In addition, an actuating line, wire or rod 51 is attached to actuating tab 49 of latch element 42 to provide means for pivotally moving the latch element 42.

Support bracket 58 has an opening for receiving and permitting axial movement of latch stem 50 and is mounted to a structural member 41 by means of conventional fastening means (not shown) cooperating with flanges 58. A coil spring 56 is disposed about latch stem 20 and one end engages support bracket 58. A thrust washer 52 is removably retained over the threaded upper end 55 of latch stem 50 by means of a load adjusting nut 54. The thrust washer 52 engages the other end of the coil spring 56 and permits limited axial movement of the latch stem 50 against the compression load of coil spring 56. Adjustment of nut 54 permits limited adjustment of the preloaded compression of coil spring 56 by thrust washer 56 for adjusting the load exerted by coil spring 56 against thrust washer 56 and hence exerted against latch stem 50.

FIG. 7 shows another feature of support bracket 58 in which an opposing pair of downward extending lugs 70 which form vertical surfaces 71 adjacent to the vertical sides of the clevis 46, with a small clearance between said surfaces 71 and said sides of clevis 46, said clearance allowing tilt of latch stem 50 relative to said bracket 58 in the operating plane of the latch, said lugs 70 further preventing rotation of clevis 46 and hence latch 42 about the axial centerline of latch stem 50.

The load regulating action, including axial movement of latch stem 50 in response to increased loading, is identical to that described with relation to the previously discussed embodiments. The spring loading of latch stem 50 permits a maximum axial travel of latch element 42 as shown at Z in FIG. 7. However, the third embodiment shown in FIGS. 5, 6 and 7 also includes a tilt feature that permits limited tilt of the latch element 42 in the lateral or operating planes, which will now be described in detail.

Latch stem 50 carries a tilt means or shoulder 57 adjacent the clevis 46 end and has a flat seating surface 57 for seating engagement with the flat lower surface 59 of mounting bracket 58 during axial movement of latch stem 50. The shoulder also has two pair of opposed downwardly slanted surfaces 62, 63 adjacent the edges of the shoulder. The intersection of the slanted surfaces 62, 63 and flat surface 57 of the shoulder form discrete tilt lines or edges 65, the function of which will be hereinafter further described. In addition, the opening in support bracket 58 through which latch stem 50 passes has an enlarged annular space 60 for permitting limited tilt of latch stem 50 within the annular space 50 by deforming the coil spring 56 to one side, tilt in the lateral plane being due to loading of a space vehicle caused by engine thrust, maneuver loads, thermal gradients, etc., that result in relative lateral motion between latch element 42 and strike roller 44, and tilt in the operating plane being used to reduce the strike 44 load on the latch surface 43 by motion of the latch support clevis 46 toward the strike 44 which occurs with tilting. Such axial displacement of the clevis 46 can occur with spring 56 compression, but the strike 44 load on the latch surface 43 is increased, whereas tilting produces a decrease in such load.

Maximum lateral tilt of latch element 42 is shown in FIG. 6 at Y. During lateral tilt, the lateral load acting on latch element 42 and transmitted to latch stem 50, causes the latch stem 50 to tilt against the side loading of coil spring 56. Such tilting will pivot the latch clevis 46 about one of the parallel pair of tilt lines or edges 65 associated with surfaces 63 as a pivot point. In practice, lateral tilt motion of 0.25 inches was permitted between latch element 42 and strike roller 44. To permit the 0.25 inches of lateral tilt (5.6° of tilt) the annular space 60 between latch stem 50 and support bracket 58 needs only be on the order of 0.0024 inches. All of the other features and advantages of the load regulating mechanical latch shown as embodiments 10 and 35 are the same for embodiment 40 and therefore need not be described or discussed further.

Tilt in the operating plane is necessary when a latch strike roller 44 jams or if an overload has caused the strike roller 44 to indent the hook 43 surface and is presenting an obstruction to the strike roller 44. Tilting in the operating plane moves the latch clevis 46, and hence the latch hook 42, nearer the strike roller 44, thereby relieving the strike load and facilitating further strike engagement or disengagement. The latch hook 42 is moved nearer the strike roller 44 by 0.012 inches at a maximum of 5.6° of tilt. Such tilting of the clevis 46 in the operating plane will occur when the clevis 46 tilts or pivots about one of the parallel pair of tilt lines or edges 65 associated with surfaces 62 as a pivot point.

FIG. 9 shows an alternate structure of the latch stem 50 and its fit in relation to the opening in support bracket 58. Disposed on latch stem 50, immediately adjacent shoulder 57 is a slanted frusto-conical surface 66 which acts as the latch stem 50 interface with the hole in the support bracket 58. The conical shape allows the cylindrical opening in support bracket 58 to be a close fit with relation to the larger diameter of the conical surface 66.

Numerous variations and modifications may obviously be made in the structure herein described without departing from the present invention. Accordingly, it should be clearly understood that the forms of the invention herein described and shown in the figures of the accompanying drawings are illustrative only and are not intended to limit the scope of the invention.

What is claimed is:

1. A load-regulating mechanical latch, comprising:

a prepositioned strike roller;

a latch element adapted for pivotal mounting comprising a laterally open hook having a surface for engagement with said strike roller;

means for pivotally moving said latch element;

a latch stem having pivotal mounting means at one end for pivotal mounting to said latch element;

a support bracket having an opening therein for receiving and supporting said latch stem;

adjustable loading means cooperating with said latch stem and said support bracket for permitting selected axial movement of said latch stem whereby a predetermined load is exerted between said latch element strike roller-engaging surface and said strike roller.

2. The load regulating latch defined in claim 1, wherein said adjustable loading means comprises compression spring means disposed around said latch stem, one end of said spring means engaging said support bracket, a thrust washer removably attached to the end of said latch stem and engaging the other end of said compression spring means for permitting limited axial movement of said latch stem, and a load adjusting nut removably attaching said thrust washer to the end of said latch stem and permitting limited adjustment of the spacing between said end of said latch stem and said thrust washer for adjusting the load exerted by said compression spring means against said thrust washer and latch stem.

3. The load regulating latch defined in claim 2, wherein said compression spring means is a coil spring.

4. The load regulating latch defined in claim 2, wherein said compression spring means is comprised of a plurality of disc type springs.

5. The load regulating latch defined in claim 1, wherein said latch stem includes a plurality of radially extending axially disposed splines over a portion of its length and wherein said support bracket includes slots for mating engagement with said splines thereby permitting relative axial movement between said latch stem and said support bracket but prohibiting relative rotational movement between said latch stem and said support bracket.

6. The load regulating latch defined in claim 2, further including tilt means disposed on said latch stem and cooperating with said latch stem, support bracket and adjustable loading means for permitting limited tilt of said latch stem element.

7. The load regulating latch defined in claim 6, wherein the opening in said support bracket allows axial passage therethrough by said latch stem and is sufficient to permit limited tilt of said latch stem and said pivotally mounted latch element relative to said support bracket, and wherein said tilt means comprises a shoulder disposed on said latch stem adjacent its pivotal mounting end, said shoulder having a flat seating surface for seating engagement with a flat lower surface of said support bracket, said shoulder having two pairs of opposed downwardly slanted surfaces adjacent the edges of said shoulder and forming two pairs of discrete tilt edges along the intersection of said flat seating surface of said shoulder, said shoulder engaging said flat lower surface of said support bracket along one of said tilt edges for permitting pivotal movement of said shoulder relative to said support bracket along said tilt edge, one pair of said tilt edges permitting limited tilt of said latch stem and pivotally mounted latch element, and the other pair permitting limited tilt of said latch stem in the operating plane of said latch.

8. The load regulating latch defined in claim 7, wherein that portion of said latch stem that interfaces with said support bracket opening comprises a frusto-conical surface which permits said support bracket to be close fitting about the major diameter of said latch stem surface for permitting limited tilt of said latch stem and said pivotally mounted latch element relative to said support bracket.

9. The load regulating latch defined in claim 8, wherein said pivotal mounting means of said latch stem is a clevis and wherein said latch support bracket includes an opposing pair of downwardly extending lugs which form vertical surfaces adjacent to the vertical sides of said clevis with a small clearance therebetween, said clearance between said vertical surfaces allowing limited tilt of said clevis in the operating plane of said latch, said vertical surfaces of said lugs preventing rotation of said clevis and said latch hook element about the axial centerline of said latch stem.

10. The load regulating latch defined in claim 2, further including overload stop means for limiting axial movement of said latch stem.

11. The load regulating latch defined in claim 10, wherein said overload stop means comprises a housing disposed about said compression spring means, said latch stem and said thrust washer and supported by said support bracket, and a shoulder laterally disposed about the inner periphery of said housing and below said thrust washer for engaging said thrust washer after a predetermined compression load has been applied to said compression spring means thereby preventing damage to said compression spring means.

12. The load regulating latch defined in claim 1, including verifying means cooperating with said latch stem, said support bracket and said adjustable loading means for verifying that limited axial movement of said latch stem has occurred during engagement of said latch element and said strike roller.

13. The load regulating latch defined in claim 12, wherein said verifying means comprises a washer disposed about said latch stem and having a radially extending tab member, said washer being clamped between said pivotal mounting means of said latch stem and said support bracket when said latch element is disengaged, and force-exerting means cooperating with said tab member to exert a lateral force on said tab member for rotating said washer and said tab member when said latch element and said strike roller are engaged and said adjustable loading means permits said pivotal mounting means to separate axially of said latch stem from said support bracket.

14. A load regulating mechanical latch, comprising a prepositioned strike roller, a hook-shaped latch element having a strike roller-engaging, laterally open hook at one end and the other end adapted for pivotal mounting, means for pivotally moving said latch element, a latch stem having a clevis element at one end for pivotal mounting to said latch element, a support bracket having an opening therein for supporting said lacth stem and said pivotally mounted latch element in strike roller-engaging position, adjustable loading means cooperating with said latch stem and said support bracket for permitting limited axial movement of said latch stem and adjustable for exerting a predetermined load between said latch element and said strike roller, and tilt means disposed on said latch stem and cooperating with said latch stem, said support bracket and said adjustable loading means for permitting limited tilt of said latch element.

15. The load regulating latch defined in claim 14, wherein said adjustable loading means comprises compression spring means disposed around said latch stem, one end of said spring means engaging said support bracket, a thrust washer removably attached to the end of said latch stem and engaging the other end of said compression spring means for permitting limited axial movement of said latch stem, and a load adjusting means removably attaching said thrust washer to the end of said latch stem and permitting limited adjustment of the spacing between said end of said latch stem and said thrust washer for adjusting the load exerted by said compression spring means against said thrust washer and latch stem.

16. The load regulating latch defined in claim 15, wherein the opening in said support bracket allows axial passage therethrough by said latch stem and is of sufficient size to permit limited tilt of said latch stem and said pivotally mounted latch element relative to said support bracket, and wherein said tilt means comprises a shoulder disposed on said latch stem adjacent its clevis element end, said shoulder having a flat seating surface for seating engagement with a flat lower surface of said support bracket during axial movement of said latch stem, said shoulder having two pairs of opposed downwardly slanted surfaces adjacent the edges of said shoulder and forming two pairs of discrete tilt edges along the intersection of said flat seating surface of said shoulder, said shoulder engaging said flat lower surface of said support bracket along one of said tilt edges for permitting pivotal movement of said shoulder relative to said support bracket along said tilt edge for permitting limited tilt of said latch stem and said pivotally mounted latch element.

17. The load regulating latch defined in claim 16, wherein said compression spring means is a coil spring.

18. The load regulating latch defined in claim 16, wherein said compression spring means is comprised of a plurality of disc type springs.

19. The load regulating latch defined in claim 14, wherein said latch stem includes a plurality of radially extending axially disposed splines over a portion of its length and wherein said support bracket includes slots for mating engagement with said splines thereby permitting relative axial movement between said latch stem and said support bracket but prohibiting relative rotational movement between said latch stem and said support bracket.

20. The load regulating latch defined in claim 16, wherein that portion of said latch stem that interfaces with the support bracket opening comprises a frustoconical surface which permits said support bracket to be close fitting about the major diameter of said latch stem surface for permitting limited tilt of said latch stem and said pivotally mounted latch element relative to said support bracket.

21. The load regulating latch defined in claim 16, wherein said latch support bracket includes an opposing pair of downwardly extending lugs which form vertical surfaces adjacent to the vertical sides of said clevis with a small clearance there between, said clearance between said vertical surfaces allowing limited tilt of said clevis in the operating plane of said latch, said vertical surfaces of said clevis and said latch hook element about the axial centerline of said latch stem.

22. The load regulating latch defined in claim 16, further including overload stop means for limiting axial movement of said latch stem.

23. The load regulating latch defined in claim 22, wherein said overload stop means comprises a housing disposed about said compression spring means, said latch stem and said thrust washer and supported by said support bracket, and a shoulder laterally disposed about the inner periphery of said housing and below said thrust washer for engaging said thrust washer after a predetermined compression load has been applied to said compression spring means thereby preventing damage to said compression spring means.

24. The load regulating latch defined in claim 14, including verifying means cooperating with said latch stem, said support bracket and said adjustable loading means for verifying that limited axial movement of said latch stem has occurred during engagement of said latch element and said strike roller.

25. The load regulating latch defined in claim 24, wherein said verifying means comprises a washer disposed about said latch stem and having a radially extending tab member, said washer being clamped between said clevis element of said latch stem and said support bracket when said latch element is disengaged, and force exerting means cooperating with said tab member to exert a lateral force on said tab member for rotating said washer and said tab member when said latch element and strike roller are engaged and said adjustable loading means permits said clevis element to separate axially to said latch stem from said support bracket.

* * * * *